US006247490B1

(12) United States Patent
Mosher et al.

(10) Patent No.: US 6,247,490 B1
(45) Date of Patent: Jun. 19, 2001

(54) BOOSTER STATION

(75) Inventors: Randall Lee Mosher, Loudonville; David W. Oswalt, Mansfield, both of OH (US)

(73) Assignee: The Gorman-Rupp Company, Mansfield, OH (US)

( * ) Notice: Subject to any disclaimer, the term of this patent is extended or adjusted under 35 U.S.C. 154(b) by 0 days.

(21) Appl. No.: 09/478,637

(22) Filed: Jan. 6, 2000

(51) Int. Cl.[7] ..... F16L 5/00
(52) U.S. Cl. ..... 137/363; 137/372
(58) Field of Search ..... 137/363, 372

(56) References Cited

U.S. PATENT DOCUMENTS

| | | | | |
|---|---|---|---|---|
| 3,938,545 | * | 2/1976 | Nagy et al. | 137/363 |
| 4,269,240 | * | 5/1981 | Cutore | 141/392 |
| 4,348,158 | * | 9/1982 | Wood | 417/40 |
| 4,865,526 | | 9/1989 | Clark et al. . | |
| 5,538,035 | * | 7/1996 | Gavin | 137/363 |

* cited by examiner

*Primary Examiner*—A. Michael Chambers
*Assistant Examiner*—Thomas L. McShane

(74) *Attorney, Agent, or Firm*—Watts, Hoffmann, Fisher & Heinke Co., L.P.A.

(57) ABSTRACT

A booster station having an integral foundation preinstalled prior to shipment to an installation site. An above ground pump enclosure houses at least one pump. Each pump has a pump inlet for receiving water and a pump outlet for discharging water at a predetermined pressure. A relatively rigid concrete foundation is integral to the pump enclosure. The foundation has an inner wall surface forming a chamber, an outer wall surface, a top wall supporting the pump enclosure, and a foundation floor opposite the top wall having an opening therein for allowing drainage of fluid from the chamber.

The foundation has at least one inlet port for receiving water and at least one outlet port for discharging water to a water transport system. The inlet and outlet pipes are connected to the foundation ports at a first end and to the purrip at a second end. The inlet and outlet pipes include a relatively flexible synthetic rubber boot located at the first end that extends through the foundation outer wall surface. The pipe is adapted to be connected to the water transport system. A plurality of pipe restraints rigidly secure the inlet and outlet pipes within the foundation. Non-compactible material such as pea gravel may fill the chamber.

8 Claims, 2 Drawing Sheets

BOOSTER STATION

TECHNICAL FIELD

The present invention relates generally to pumping apparatus and in particular to a partially buried booster station for increasing the pressure of water being transferred from one location from another.

BACKGROUND ART

Booster stations are commonly used to assist in the transfer of water from one location to another. Booster stations commonly employ a pump which receives the water, boosts the pressure of the water to a desired level and discharges the water for transfer to a location downstream from the booster system. A system of pipes within the booster station connect the pump to underground water pipes. The pump is enclosed in a station enclosure located above ground. When installed in the field, the station enclosure is supported by a foundation within the ground. The system of booster station pipes are located within the foundation and connect to the underground water pipes that extend through the foundation walls.

Field installation of a typical booster station is a relatively lengthy and complex process. After excavating the desired location along the water transfer system, a concrete foundation is poured around the existing underground water pipes. The foundation usually consists of four walls and a partial foundation floor which has a relatively large opening for fluid drainage. The foundation must cure a minimum amount of time before the booster station must be installed, so completion of the booster station is delayed during this cure time. In addition, in many regions of the country weather conditions prevent pouring of concrete during the winter months thereby limiting the season during which booster stations may be installed.

Once the foundation has properly cured, the booster station pipes are installed. Because the underground water pipes are fixed in place by the poured concrete foundation, misalignment between the underground pipes and those of the booster station may cause difficulty in the installation process. The booster station pipes are connected to the water pipes and routed to the above ground pump. Thrust blocks, which may require significant adjustments, are used to support and locate the booster station pipes during installation. The booster station pipes must be pressure tested after they are installed to verify that the connections will hold during booster station operation. This field testing of the pipes is time consuming and if a defect is detected, replacement parts not available in the field may be needed, further delaying installation.

The pouring of the concrete foundation, field connection of the attendant components, and testing of the booster station pipes adds significant cost and delay to the installation of booster stations.

DISCLOSURE OF THE INVENTION

The present invention provides a new and improved booster station which reduces the time and expense of installation. The present invention provides a prefabricated foundation which eliminates the need for pouring a foundation in the field. The present invention also provides a booster station which is essentially completely assembled but for connection to the underground water pipes, so that thrust blocks and field installation of station pipes is no longer necessary. The present invention provides a booster station which more easily compensates for misalignment between the underground water pipes and station pipes by eliminating the need for a poured foundation.

In the preferred and illustrated embodiment, the booster station comprises an above ground pump enclosure, a pump mounted within the pump enclosure for receiving water and discharging water at a predetermined pressure and a relatively rigid foundation integral to the pump enclosure. The foundation has an inner wall surface forming a chamber, an outer wall surface, a top wall supporting the pump enclosure, and a foundation floor opposite the top wall. The foundation is adapted to be buried in the ground during installation of the booster station. A relatively large opening in the top wall of the foundation allows for placement of backfill material such as pea gravel.

The present invention provides a fully assembled booster station including the prefabricated foundation and the plumbing contained within the station. Inlet and outlet ports in the foundation receive water from and discharge water to, respectively, the water transport system. An inlet pipe is connected between the foundation inlet port and the pump inlet. Similarly, an outlet pipe is connected between the foundation outlet port and the pump outlet. To facilitate station installation and allow for settling of the station after installation, the inlet and outlet pipes include a relatively flexible boot extending through the foundation outer wall surface. The pipes protrude through the boots and are connected to the water transport system. A plurality of pipe restraints rigidly secure the inlet and outlet pipes within the foundation. Field installation of a booster station in accordance with the present invention requires only the excavation of the installation site and connection to the underground water pipes. The plumbing located within the station may be tested at the factory, eliminating the need for field testing of connections. As such, booster stations in accordance with the present invention significantly reduce installation time and expense. Further, weather conditions no longer limit the installation of booster stations in accordance with the present invention.

According to a feature of this embodiment, the foundation floor includes an opening therein to allow for drainage of water from the foundation. In the preferred arrangement, non-compactible backfill such as pea gravel fills the foundation chamber to filter drainage and to support the inlet and outlet pipes against hydraulic forces. In the preferred arrangement, the foundation is made of concrete, but fiberglass is also suitable. The flexible boots of the inlet and outlet pipes may be made of synthetic rubber or other flexible material.

Additional features of the invention will become apparent and a fuller understanding obtained by reading the following detailed description made in connection with the accompanying drawings.

DETAILED DESCRIPTION OF THE PREFERRED EMBODIMENT

Figure 1:
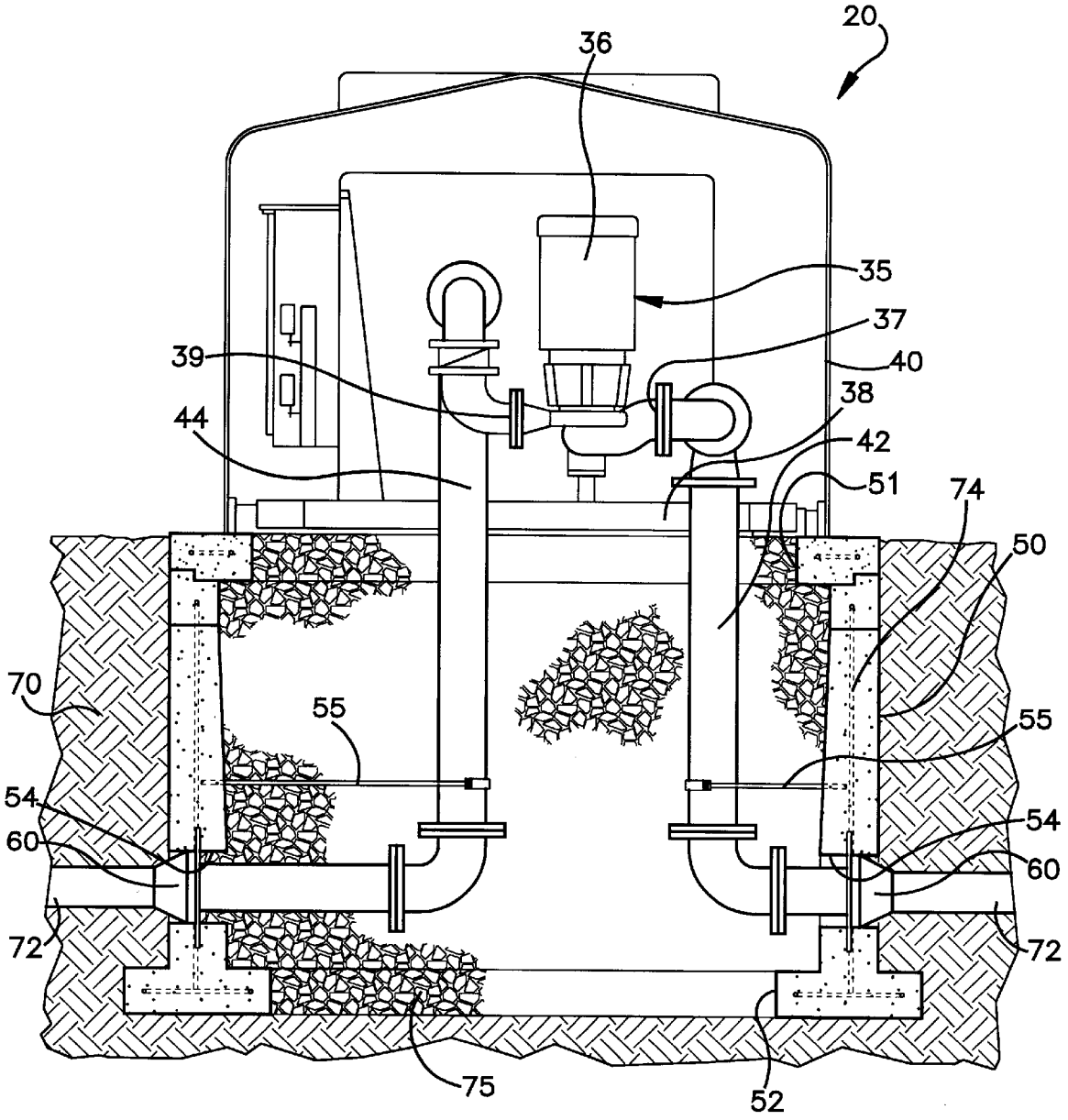
FIG. 1 is a cross section view of a booster station constructed in accordance with the present invention.

Referring to FIG. 1, a booster station 20 in accordance with the present invention is illustrated. A pressure boosting pump assembly 3 5 is mounted within a pump enclosure 40 to protect it from damage from the elements or unauthorized access. The pump assembly 35 consists of a pump 36 and inlet and outlet ports 37, 39. The pump assembly 36 is adapted to receive potable water, boost its pressure to an acceptable level, and discharge the water for transport to another location.

Figure 2A:
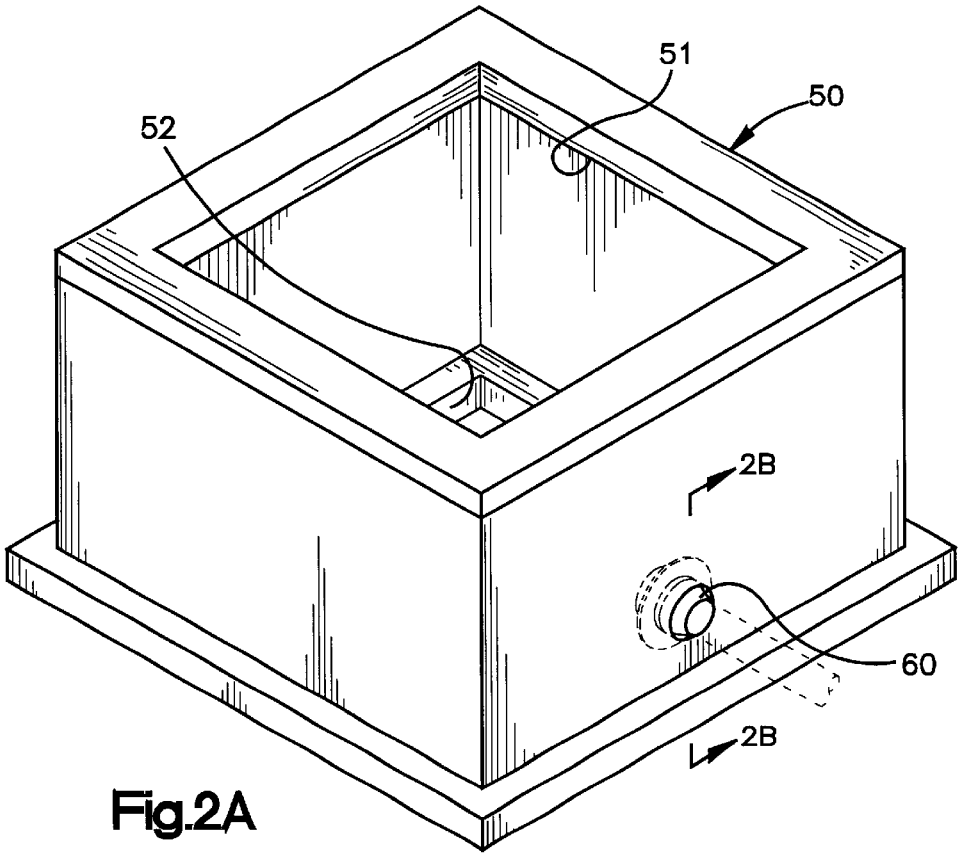
FIG. 2A is a perspective view of the prefabricated foundation of the booster station of FIG. 1.
Figure 2B:
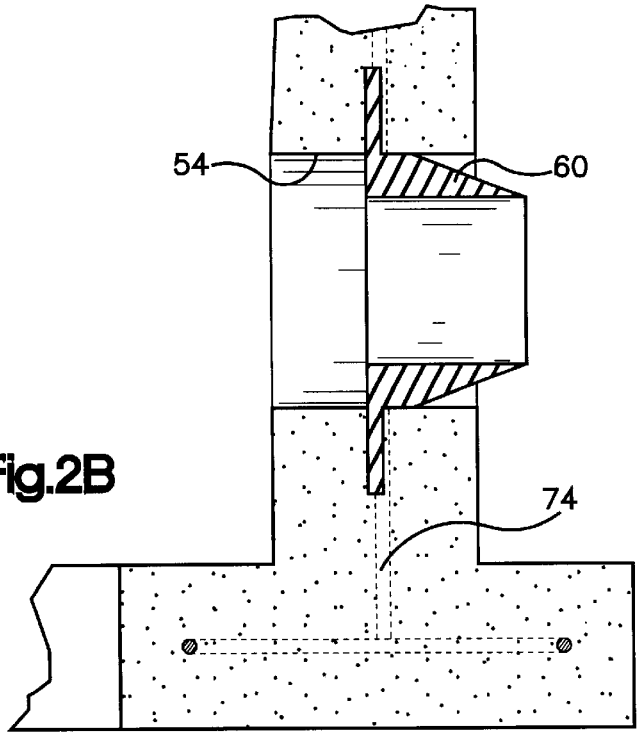
FIG. 2B is an enlarged fragmentary view of the flexible boots use to connect the booster station of FIG. 1 to an in ground water supply line.

A prefabricated foundation 50 (also shown in FIG. 2A), made of rigid material such as concrete or fiberglass, is connected to and supports the pump enclosure 40. The pump enclosure 40 is connected to the foundation using cast in place "J" bolt anchors (not shown). A steel support structure 38, such as a system of I-beams, supports the pump assembly 35 within the pump enclosure. The foundation 50 is substantially buried in soil 70 and has a top opening 51, a bottom opening 52, and two foundation ports 54 for connecting the booster station to underground water lines 72. The foundation 50 is reinforced with reinforcing rod 74 (shown in phantom). Steel pipe supports 55 are cast into the foundation 50, as are synthetic rubber boots 60 (also shown in FIGS. 2A and 2B).

Inlet and outlet pipes 42, 44 connect the pump inlet and outlet ports 37, 39 to the boots 60. The top opening 51 in the foundation allows the inlet and outlet pipes 42, 44 to travel between the pump assembly 35 and the ports 60. The booster station 20 is assembled at the factory complete with the pump assembly 35, the pump enclosure 40, the foundation 51, boots 60, the pipe supports 55, and the pipes 42, 44. Upon arrival at the installation site, the foundation 50 is buried in the soil 70. The pipes 42,44 are connected to the underground water line 72 to complete installation. Pea gravel or other non-compactible fill 75 may be poured into the foundation through removable panels (not shown) in the pump enclosure 40 to provide filtration for drainage through the bottom opening 52 and support the pipes 42, 44 against hydraulic forces.

Although the invention has been described with a certain degree of particularity it should be understood that those skilled in the art can make various changes to it without departing from the spirit or scope of the invention as hereinafter claimed.

We claim:

1. A booster station for regulating pressure within a water transport system, said station comprising:

a) an above ground pump enclosure;

b) at least one pump mounted within said pump enclosure, each of said pumps comprising a pump inlet for receiving water and a pump outlet for discharging water at a predetermined pressure;

c) a relatively rigid foundation integral to said pump enclosure, wherein said foundation has an inner wall surface forming a chamber, an outer wall surface, a top wall supporting said pump enclosure, and a foundation floor opposite said top wall, said foundation adapted to be buried in the ground;

d) at least one inlet port in said foundation for receiving water from said water transport system;

e) at least one outlet port in said foundation for discharging water to said water transport system;

f) at least one inlet pipe connected to said inlet port at a first end and connected to said pump inlet at a second end, wherein said inlet pipe comprises a relatively flexible boot located at said first end, said flexible boot extending beyond said foundation outer wall surface and adapted to be connected to said water transport system;

g) at least one outlet pipe connected to said outlet port at a first end and connected to said pump outlet at a second end, wherein said outlet pipe comprises a relatively flexible boot located at said first end, said flexible boot extending beyond said foundation outer wall surface and adapted to be connected to said water transport system; and h) a plurality of pipe restraints rigidly securing said inlet and outlet pipes within said foundation.

2. The booster station of claim 1 wherein said foundation floor comprises an opening therein for allowing drainage of fluid from said chamber.

3. The booster station of claim 1 further comprising non-compactible backfill material within said chamber.

4. The booster station of claim 1 wherein said foundation is made of fiberglass.

5. The booster station of claim 1 wherein said foundation is made of concrete.

6. The booster station of claim 3 wherein said backfill material comprises pea gravel.

7. The booster station of claim 1 wherein said flexible boots are made of synthetic rubber.

8. A booster station for regulating pressure within a water transport system, said station comprising:

a) an above ground pump enclosure;

b) at least one pump mounted within said pump enclosure, each of said pumps comprising a pump inlet for receiving water and a pump outlet for discharging water at a predetermined pressure;

c) a relatively rigid concrete foundation integral to said pump enclosure, wherein said foundation has an inner wall surface forming a chamber, an outer wall surface, a top wall supporting said pump enclosure, and a foundation floor opposite said top wall having an opening therein for allowing drainage of fluid from said chamber, said foundation adapted to be buried in the ground;

d) at least one inlet port in said foundation for receiving water from said water transport system;

e) at least one outlet port in said foundation for discharging water to said water transport system;

f) at least one inlet pipe connected to said inlet port at a first end and connected to said pump inlet at a second end, wherein said inlet pipe comprises a relatively flexible synthetic rubber boot located at said first end, said flexible boot extending beyond said foundation outer wall surface and adapted to be connected to said water transport system;

g) at least one outlet pipe connected to said outlet port at a first end and connected to said pump outlet at a second end, wherein said outlet pipe comprises a relatively flexible synthetic rubber boot located at said first end, said flexible boot extending beyond said foundation outer wall surface and adapted to be connected to said water transport system; and h) a plurality of pipe restraints rigidly securing said inlet and outlet pipes within said foundation.

* * * * *